US006386438B1

(12) United States Patent
Walsh et al.

(10) Patent No.: US 6,386,438 B1
(45) Date of Patent: May 14, 2002

(54) CARTON BLANK, CARTON AND METHOD OF FORMING THE CARTON

(75) Inventors: Joseph C. Walsh, Boulder; Robert L. Conatser; Raymond S. Kastanek, both of Longmont, all of CO (US)

(73) Assignee: Graphic Packaging Corporation, Golden, CO (US)

( * ) Notice: Subject to any disclaimer, the term of this patent is extended or adjusted under 35 U.S.C. 154(b) by 0 days.

(21) Appl. No.: 09/607,197

(22) Filed: Jun. 28, 2000

(51) Int. Cl.[7] ..... B65D 3/00

(52) U.S. Cl. ..... 229/117.27; 229/117.3; 229/217; 229/219; 229/213

(58) Field of Search ..... 229/117.27, 217, 229/117.3, 231, 215, 219; 53/449; 493/96, 114, 907

(56) References Cited

U.S. PATENT DOCUMENTS

| | | | | | |
|---|---|---|---|---|---|
| 1,907,067 | A | * | 5/1933 | Harmann | 229/117.27 X |
| 1,998,717 | A | * | 4/1935 | Guyer | 229/225 |
| 2,010,863 | A | | 8/1935 | Johnson | |
| 2,114,623 | A | * | 4/1938 | Bergstein | 229/117.27 X |
| 2,950,036 | A | * | 8/1960 | Vergobbi | 229/117.27 X |
| 2,982,461 | A | * | 5/1961 | Hultin | 229/117.27 X |
| 3,347,446 | A | | 10/1967 | Guyer et al. | |
| 3,484,034 | A | | 12/1969 | Sternau | |
| 3,764,058 | A | | 10/1973 | Forbes, Jr. et al. | |
| 4,194,677 | A | | 3/1980 | Wysocki | |
| 4,913,292 | A | | 4/1990 | Field | |
| 5,031,825 | A | | 7/1991 | Romagnoli | |
| 5,141,150 | A | | 8/1992 | Plaessmann | |
| 5,222,660 | A | | 6/1993 | Koss | |
| 5,373,960 | A | | 12/1994 | Gunn et al. | |
| 5,505,374 | A | | 4/1996 | Stone | |
| 5,515,996 | A | | 5/1996 | Stone | |
| 5,632,404 | A | | 5/1997 | Walsh | |
| 5,642,599 | A | | 7/1997 | Tisma | |
| 5,788,102 | A | | 8/1998 | Hall et al. | |
| 5,819,924 | A | * | 10/1998 | Sigrist et al. | 229/244 X |
| 5,857,614 | A | | 1/1999 | Walsh | |
| 5,875,963 | A | | 3/1999 | Stone et al. | |
| 5,911,359 | A | | 6/1999 | Stone et al. | |
| 6,062,467 | A | | 5/2000 | Ours et al. | |
| 6,195,959 | B1 | | 3/2001 | Tisma | |
| 6,223,507 | B1 | | 5/2001 | Tisma | |

* cited by examiner

*Primary Examiner*—Lee Young
*Assistant Examiner*—Tri M. Mai
(74) *Attorney, Agent, or Firm*—Klaas, Law, O'Meara & Malkin, P.C.; Joseph J. Kelly, Esq.; Michael A. Goodwin, Esq.

(57) ABSTRACT

A carton blank having an outer layer of a relatively rigid material, a first inner layer of a relatively rigid material superposed over a portion of the outer layer and a second inner layer of a relatively flexible layer of a fluid impervious material is provided with first and second weakened portions so that, after a carton has been formed from the carton blank, filled with a desired material and sealed, the first weakened portion may be broken to form a flip top lid which when moved in an arcuate path will gradually sever the second weakened portion to form an opening in the carton so that an amount of the desired material may be removed from the carton.

21 Claims, 5 Drawing Sheets

CARTON BLANK, CARTON AND METHOD OF FORMING THE CARTON

FIELD OF THE INVENTION

This invention is directed generally to a carton blank and a carton formed therefrom and more particularly to a fluid impermeable carton from which the material contained therein may be readily removed.

BACKGROUND OF THE INVENTION

In order to protect moisture sensitive materials in a carton, there have been many kinds of fluid impervious cartons developed to protect such moisture sensitive materials from deleterious elements such as the humidity in the air. The vast majority of these leakproof cartons have an outer layer formed from a relatively rigid material and an inner layer formed from a relatively flexible fluid impervious material to provide the moisture protection. When it is desired to remove an amount of the material in the carton, it is necessary to open both the outer and inner layers. It is desirable that an opening be formed in both the outer and inner layers at the same time. Also, it is desirable that such an opening be located so that it is not necessary to make an oversized carton so that none of the material in the carton is spilled during the opening thereof. Another desired advantage is that the structures associated with making the opening be of a nature that such structures may be returned to substantially the original position to further protect the material remaining in the carton. This invention provides such a carton.

BRIEF DESCRIPTION OF THE INVENTION

This invention relates to a carton blank and a carton formed therefrom wherein the carton has a fluid impervious liner and a flip top lid and a pouring spout formed by securing an insert to the carton blank so that weakened portions in an outer layer of the carton and in the fluid impervious liner may be broken to form a pour spout for removing the material contained in the carton.

In a preferred embodiment of the invention, the carton blank comprises an outer layer comprising a first generally rectangular sheet of a relatively rigid material having an outer surface and an inner surface and a plurality of cut and fold lines formed therein for dividing the outer layer into a plurality of panels. The panels include at least a first sidewall panel that is integral with a second sidewall panel and a third sidewall panel and is joined thereto by opposite fold lines. First, second and third top panels are integral with the first, second and third sidewall panels and joined thereto by fold lines. A first inner layer comprising a second generally rectangular sheet of a relatively rigid material, that is substantially smaller than the first generally rectangular sheet of a relatively rigid material, has an outer surface and an inner surface and is located opposite to only portions of the first, second and third sidewall panels. The second generally rectangular sheet has a first partial sidewall panel integral with a second partial sidewall panel and a third partial sidewall panel and joined thereto by opposite fold lines. The first sidewall panel and the first partial sidewall panel have substantially the same width between the opposite fold lines thereof. The first, second and third partial sidewall panels have upper edge portions and lower edge portions with at least a portion of the first partial sidewall panel adjacent to the lower edge thereof being secured to at least a portion of the first sidewall panel. The upper edge portions are located adjacent to but spaced from the fold lines between the first, second and third sidewall panels and the first, second and third top panels. A second inner layer comprising a generally rectangular sheet of a relatively flexible fluid impervious material having an outer surface and an inner surface has at least portions of its outer surface secured to opposite portions of the inner surface of the outer layer and at least other portions of the outer surface of the second inner layer are secured to at least portions of the inner surface of the first inner layer. The second inner layer has a weakened portion located adjacent to but spaced from the upper edges and portions of the outer surface of the second inner layer surrounding the weakened portion are secured to opposite portions of the inner surface of the first inner layer. A continuous weakened portion is formed in portions of the first, second and third sidewall panels of the first generally rectangular sheet of a relatively rigid material so that an opening may be formed in the outer layer. As explained more fully below, the continuous weakened portion and the weakened portion may be broken to form an opening for the carton and a flip top lid for opening or closing the opening.

The continuous weakened portion has a first portion located in the first sidewall panel adjacent to but spaced above the at least a portion of the first sidewall panel and has end portions located in the opposite fold lines to form a frustum of a V, a second portion located in the second sidewall panel and extending at an acute angle between one of the end portions of the first portion and the fold line between the second sidewall panel and the second top panel and a third portion located in the third sidewall panel and extending at an acute angle between the other of the end portions of the first portion and the fold line between the third sidewall panel and the third top panel which when broken form the flip top lid.

The second top panel has opposite spaced apart fold lines extending in a direction substantially perpendicular to the fold line between the second top panel and the second sidewall panel with an arcuately shaped score line in the second top panel extending between the opposite spaced apart fold lines and the third top panel has opposite spaced apart fold lines extending in a direction substantially perpendicular to the fold line between said third top panel and said third sidewall panel with an arcuately shaped score line in the third top panel extending between the opposite spaced apart fold lines. The opposite spaced apart fold lines in the second and third top panels are located so that they are in a superposed position when the third top panel is superposed over the second top panel and the arcuately shaped score lines in the second and third top panels extend in opposite directions when the third top panel is superposed over the second top panel.

The above carton blank also has a fourth sidewall panel integral with one of the second and third sidewall panels and joined thereto by a fold line, a glue tab panel is integral with the fourth sidewall panel and is joined thereto by a fold line and a fourth top panel is integral with the fourth sidewall panel and is joined thereto by a fold line. The carton blank also has a first, second, third and fourth bottom panels respectively integral with the first, second, third and fourth sidewall panels and joined thereto by fold lines. In a preferred embodiment of the invention, a first strip of a relatively flexible material is superposed over at least the first second, third and fourth top panels and portions of the first, second, third and fourth sidewall panels adjacent to the fold lines between the top panels and the sidewall panels and is secured to portions of the outer surface of the second inner layer and a second strip of a relatively flexible material is superposed over at least the first, second, third and fourth bottom panels and portions of the first, second, third and fourth sidewall panels adjacent to the fold lines between the bottom panels and the sidewall panels and is secured to other portions of the outer surface of the second inner layer.

A dispensing carton having a flip top lid is formed from the above described carton blank and comprises the plurality of sidewall panels folded around the parallel fold lines and held in folded relationship by the glue tab panel to form a central body portion; the plurality of sidewall panels comprise at least one sidewall panel having integral second and third sidewall panels joined thereto by opposite fold lines; a first inner layer or inner insert having a first partial sidewall panel, a second partial sidewall panel and a third partial sidewall panel superposed over portions of the first, second and third sidewall panels; the insert having substantially parallel top and bottom edges. The first partial sidewall panel is secured to the first sidewall panel at a location adjacent to the lower edge thereof. A second inner layer comprising a continuous fluid impervious liner is provided for the carton and has a central body portion, a top portion and a bottom portion. In a preferred embodiment of the invention, a continuous strip of a relatively flexible material, such as a Kraft paper or other material having similar characteristics, is secured to each of the top portion and the bottom portion. The central body portion of the second inner layer is secured to the inner surface of the first, second, third and fourth sidewall panels and the inner surface of the first inner layer as explained more fully below. A plurality of bottom panels are integral wit the plurality of sidewall panels and are joined thereto by fold lines. A plurality of top panels are integral with the plurality of sidewall panels and are joined thereto by fold lines. The above described continuous weakened portion is formed in portions of the first, second and third sidewall panels and the weakened portion is formed in the continuous fluid impervious liner in a portion thereof parallel to but spaced below the upper edge with the portion of the fluid impervious continuous liner surrounding the second weakened portion being secured to the inner insert or first inner layer so that the continuous weakened portion and the weakened portion when broken provide an opening and a flip top lid for the carton.

After the bottom has been formed in the carton by first folding of the bottom portion of the second inner layer to form a fluid impervious bottom portion which is then covered by the folding of the bottom panels and a desired material has been deposited in the carton, the top portion of the continuous fluid impervious liner is formed into a closed and folded fluid impervious configuration, such as a fin joint or seal, having a central body portion and two opposite outwardly extending portions. The fin joint has a central section and two opposite end sections. The top panels comprise two relatively long top panels and two relatively short top panels. One of the relatively long top panels is then folded to be superposed over the central section of the fin joint. Each of the two opposite end sections and the associated short top panels are then folded over and superposed over opposite end portions of the folded one of the relatively long top panels. The other of the two relatively long top panels is then folded and superposed over and secured to the folded over two relatively short top panels and the portion of the one of the two relatively long top panels located between the folded over two relatively short top panels.

One of the two relatively long top panels has opposite spaced apart fold lines extending in a direction substantially perpendicular to a portion of the fold line between the top panels and the sidewall panels with an arcuately shaped score line in the one of said two relatively long top panels extending between the opposite spaced apart fold lines and the other of the two relatively long top panels has opposite spaced apart fold lines extending in a direction substantially perpendicular to a portion of the fold line between the top panels and the sidewall panels with an arcuately shaped score line in the other of the two relatively long top panels extending between the opposite spaced apart fold lines. The opposite spaced apart fold lines in the one and other top panels are located so that they are in a superposed position when the one top panel is superposed over the other top panel; and the arcuately shaped score lines in the one and other top panels extend in opposite directions when the other top panel is superposed over the one top panel so that when the first and second continuous weakened portions are broken open, at least the superposed portions of the two relatively long top panels and one of the folded over two relatively short panel can be pivoted around the fold lines in the two relatively long top panels and the portions of the two relatively long top panels defined by the score lines are in a superposed relationship to hold the flip top lid in an opened position.

A method for forming a secured together top portion for a container comprising at least an outer layer comprising a plurality of sidewall panels and a glue panel folded around fold lines and secured together; a plurality of bottom panels integral with said plurality of sidewall panels and joined thereto by fold lines; a plurality of top panels integral with said plurality of sidewall panels and joined thereto by fold lines and wherein the plurality of top panels comprise two relatively long top panels and two relatively short top panels; at least an inner layer comprising a flexible fluid impervious material having a central body portion, a bottom portion and a top portion wherein the central body portion is secured to at least portions of the plurality of sidewall panels and wherein the plurality of bottom panels and the bottom portion are folded and secured together to form an open ended carton ready to be filled with a desired material and wherein the fold lines between the plurality of top panels and the plurality of sidewall panels lie in a common plane and wherein, after the open ended carton has been filled with a desired material, the method comprises folding and continuously sealing together portions of the top portion in a fin joint so as to have a central body portion and two opposite outwardly extending portions lying substantially in the common plane with the central body portion and extending in a direction substantially parallel with the two relatively long top panels; the fin joint having a central section and two opposite end sections folding one of the two relatively long top panels to a location wherein it is superposed over the central section; folding each of the two relatively short top panels so that one of the two opposite end sections are located between of the two relatively short top panels and the spaced apart portions of the one of the two relatively long top panels; folding the other of the two relatively long top panels until it is superposed over the folded two relatively short top panels and the portion of the one of the two relatively long top panels located therebetween; and securing together facing portions of the other of the two relatively long top panels and the two relatively short top panels and the portion of the one of the two relatively long top panels.

BRIEF DESCRIPTION OF THE DRAWINGS

Illustrative and presently preferred embodiments of the invention are illustrated in the accompanying drawings in which.

DETAILED DESCRIPTION OF THE INVENTION

Figure 1:
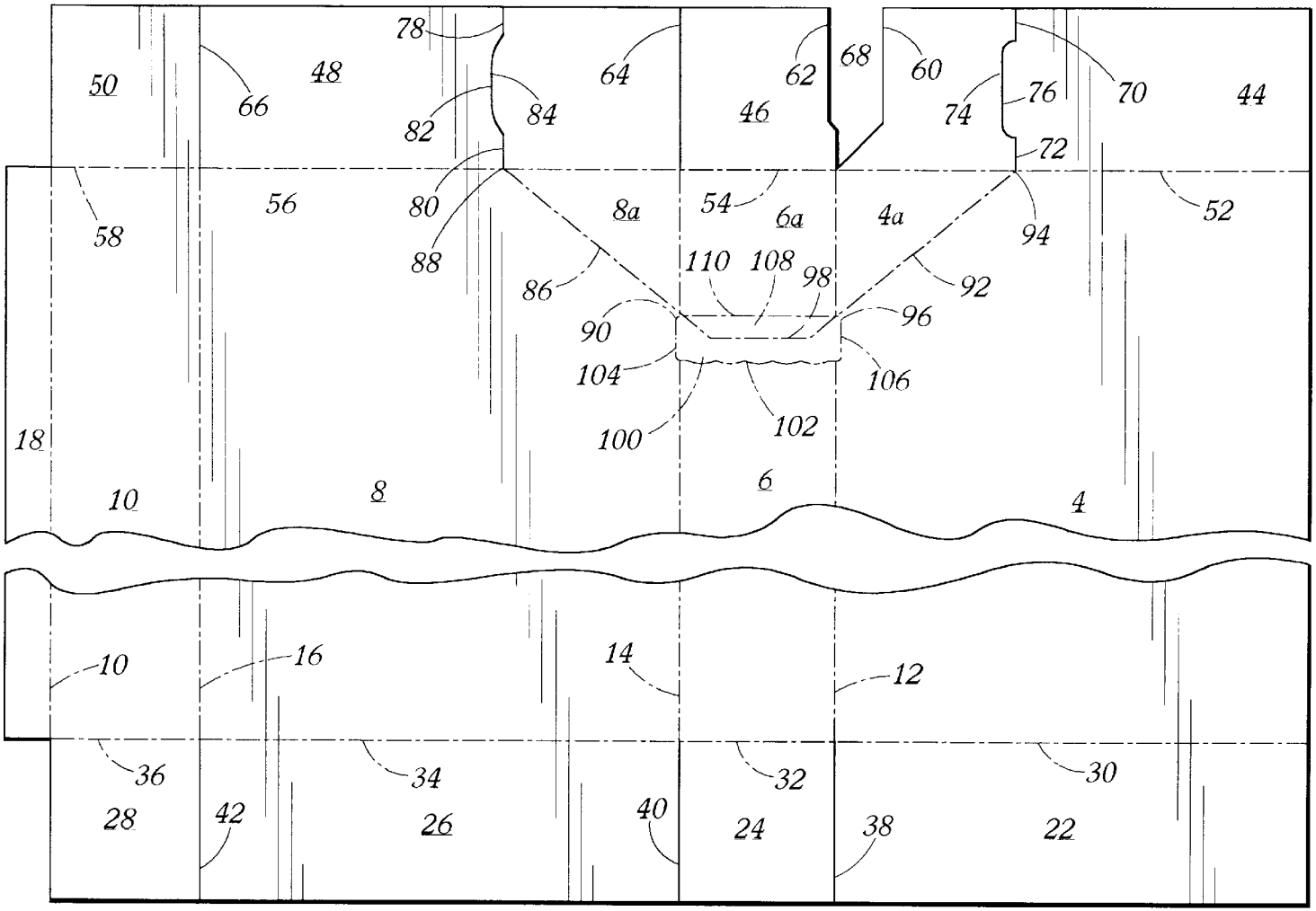
FIG. 1 is a top plan view of the outer surface of a carton blank of this invention.

In FIG. 1, there is illustrated the outer surface of a carton blank 2 of this invention. The carton blank 2 has an outer layer which comprises a generally rectangular sheet of a relatively rigid material such as paperboard, a composite materials comprising a plastic film laminated to paperboard or any other conventional material used in forming cartons and has a plurality of integral sidewall panels 4, 6, 8 and 10 which are joined together by fold lines 12, 14 and 16 and a glue tab panel 18 integral with the sidewall panel 10 and joined thereto by a fold line 20. A plurality of bottom panels 22, 24, 26 and 28 are integral with the sidewall panels 4, 6, 8 and 10 and are joined thereto by fold lines 30, 32, 34 and 36 and are separated from each other by cut lines 38, 40 and 42. A plurality of top panels 44, 46, 48 and 50 are integral with the sidewall panels 4, 6, 8 and 10 and are joined thereto by fold lines 52, 54, 56 and 58 and are separated from each other by cut lines 60, 62, 64 and 66. The cut lines 60 and 62 are spaced apart to form an opening 68 therebetween. The top panel 44 has a pair of spaced apart opposite fold lines 70 and 72 and an arcuate shaped perforated line 74 which, when broken, forms a tab portion 76. The top panel 48 has a pair of spaced apart opposite fold lines 78 and 80 and an arcuate shaped perforated line 82 which, when broken, forms a tab portion 84. A first weakened portion 86 has a first end point 88 in the fold line 56 and a second end point 90 in the fold line 14. A second weakened portion 92 has a first end point 94 in the fold line 52 and a second end point 96 in the fold line 12. A third weakened portion 98 extends between the second end points 90 and 96 and is shaped as a frustum of a V. As illustrated in FIG. 1, the weakened portions 86, 92 and 98 form portions 4*a*, 6*a* and 8*a* in the sidewall panels 4, 6 and 8. An opening tab 100 is formed in the sidewall panel 6 by a perforated line 102 and extensions 104 and 106 thereof which extensions 104 and 106 are parallel to but spaced slightly from portions of the fold lines 12 and 14. A tab portion 108 extends from a fold line 110 for purposes described below.

Figure 2:
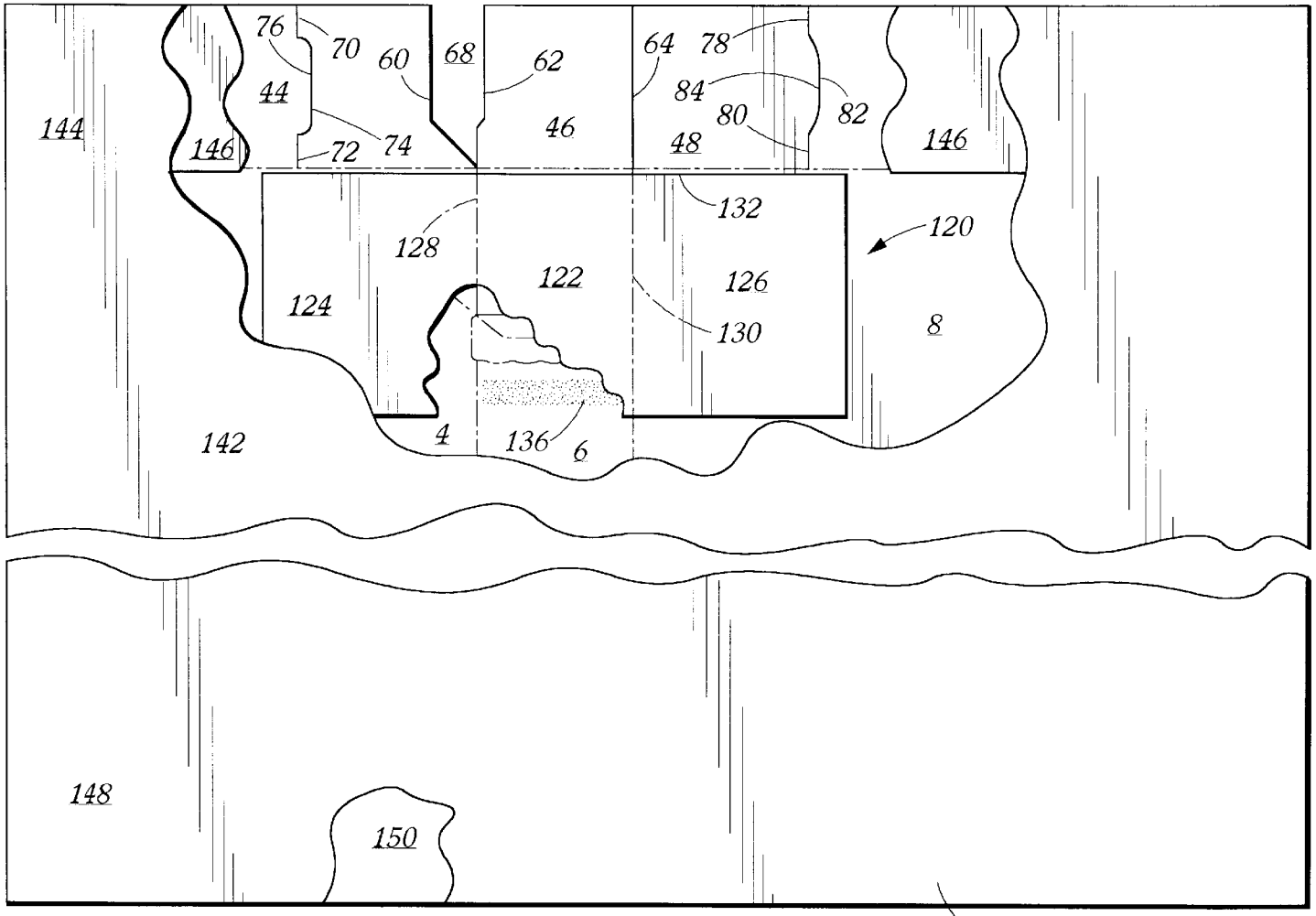
FIG. 2 is a top plan view of the inner surface of a carton blank of this invention with parts broken away.

In FIG. 2, there is illustrated the inner surface of a carton blank 2 of this invention. The portions illustrated in FIG. 2 that correspond to FIG. 1 have been identified with the same reference numerals. A first inner layer comprising a generally rectangularly shaped insert 120 has a partial sidewall panel 122 superposed over a portion of the sidewall panel 6; a partial sidewall panel 124 superposed over a portion of the sidewall panel 4 and a partial sidewall panel 126 superposed over a portion of the sidewall panel 8. The partial sidewall panel 124 and the partial sidewall panel 126 are integral with the partial sidewall panel 122 and are joined thereto by the fold lines 128 and 130 which are substantially superposed over portions of the fold lines 12 and 14. The insert 120 has an upper edge 132 that is spaced slightly from the fold line 54 and portions of the fold lines 52 and 56 and a lower edge 134. The portion of the partial sidewall panel 122 adjacent to the lower edge 134 is secured to the opposite facing inner surface of the sidewall panel 6 by a suitable adhesive 136. The first inner layer or insert 120 is preferably formed from the same type of material as the outer layer.

A second inner layer of the carton blank 2 comprises a generally rectangular sheet 140 of a fluid impervious material comprising a central body portion 142 that is superposed over at least portions of the portions of the sidewall panels 4, 6, 8 and 10 located between but spaced slightly from the fold lines 52, 54, 56 and 58 and the fold lines 30, 32, 34 and 36 and a corresponding portion of the glue tab panel 18 and all of the insert 120. The generally rectangular sheet 140 is preferably formed from a plastic material, such as polyethylene, a kraft paper covered with polyethylene or other materials having similar characteristics. At least portions of the central body portion 142 are secured to facing portions of the insert 120 and the sidewall panels 4, 6, 8 and 10 and the glue tab panel 18. The generally rectangular sheet 140 has a top portion 144 that extends from the central body portion 142 and is superposed over at least portions of the top panels 44, 46, 48 and 50 and the glue tab panel 18. In a preferred embodiment of the invention, the top portion 144 is superposed over and secured to an elongated strip 146 of a relatively flexible material, such as a kraft paper or other materials having similar characteristics. The generally rectangular sheet 140 had a bottom portion 148 that extends from the central body portion 142 and is superposed over at least portions of the bottom panels 22, 24, 26 and 28 and the glue tab panel 18. The bottom portion 148 is superposed over and secured to a strip 150 of a relatively flexible material as described above. In some instances, the strips 146 and 150 may be omitted so that the top 144 and bottom 148 portions comprise only portions of the sheet 140 of a fluid impervious material. As illustrated in FIG. 2, two of the edges of the generally rectangular sheet 140 are located in alignment with the edge of the glue tab panel 18 and the edge of the sidewall panel 4 but in some instances such edges may be offset a desired distance.

Figure 3:
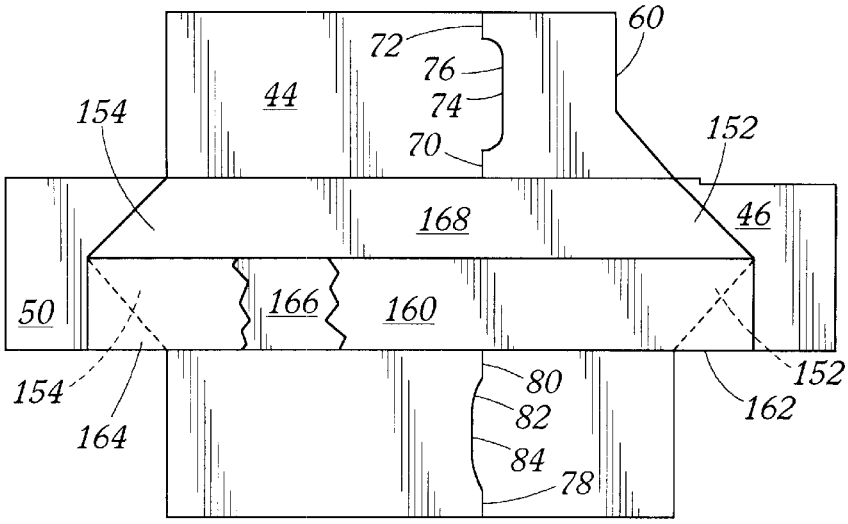
FIGS. 3–5 are top plan views illustrating different steps in the formation of the top portion of a carton from a carton blank of this invention.
Figure 4:
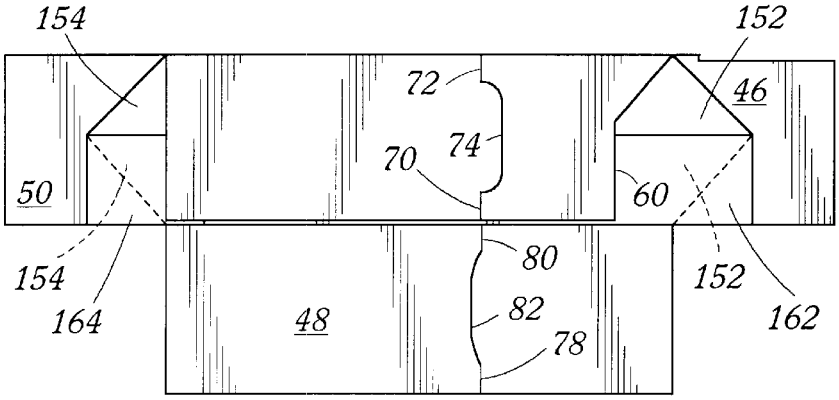
Figure 5:
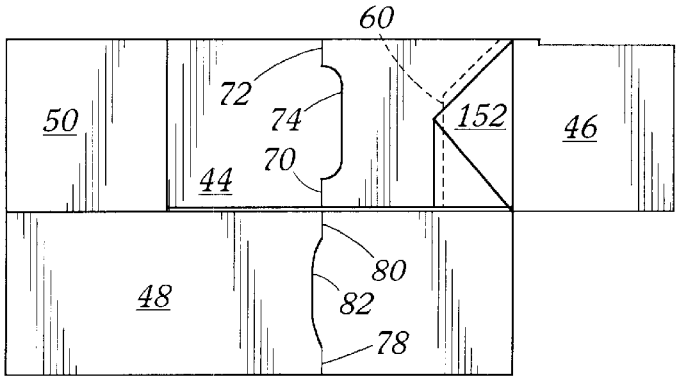

FIGS. 3–5 illustrate steps in forming a closed and sealed end for a carton formed from the carton blank 2 described in relation to FIGS. 1 and 2. The sidewall panels 4, 6, 8 and 10 are folded around the fold lines 12, 14 and 16 and secured together by a suitable arrangement between the glue tab panel 18 and a portion of the sidewall panel 4 or portions of the sheet 140 associated with structures to form an open ended structure (not shown). The bottom panels 22, 24, 26 and 28 and the bottom portion 148 with or without the strip 150 have been folded and secured together to form a closed fluid impervious bottom end for the carton. The carton is then filled with a desirable material and the top portion 144 with or without the strip 146 has been folded and sealed together to form a closed fin joint. The fin joint is formed from the top portion 144 that extends upwardly from a common plane formed by the fold lines 52, 54, 56 and 58 and comprises portions of the generally rectangular sheet 140 that extend from the sidewall panels 4, 6, 8 and 10 to form an open top portion. The portions of the generally rectangular sheet adjacent to the open top portion are secured together to form two sealed together layers having a central section 160 and two opposite end sections 162 and 164. The extensions of the top portion 144 from the sidewall panels 4 and 8 are also formed into generally horizontal portions 166 and 168 that lie in a common plane generally parallel to the above-described common plane. The generally horizontal portions 166 and 168 comprise a single thickness of the generally rectangular sheet 140. The extensions of the top portion 144 from the sidewall panels 6 and 10 and the glue tab panel 18 are also formed into triangular end sections 152 and 154 illustrated in FIGS. 3 and 4 by two reference numerals which comprise two thicknesses of the generally rectangular sheet 140. The triangular end sections 152 and 154 also lie in a plane parallel to the common planes described above. As illustrated in FIG. 3, the central section 160 and the end sections 162 and 164 of the fin joint have been folded over so that they lie substantially in the common plane formed by the fold lines 52, 54, 56 and 58. Therefore, the fin joint has a central section comprising the central section 160 and the portions 166 and 168 and two opposite end sections comprising the end sections 162 and 164 and the triangular portions 152 and 154. In FIG. 4, the top panel 44 is folded around fold line 52 until it is superposed over a major portion of the central section comprising the central body portion 160 and the portions 166 and 168 but is not secured thereto. The top panel 50 is then folded around fold line 58 so that it is superposed over a portion of the top panel 44 and the end sections 154 and 164 are sandwiched in between. These portions are not adhesively secured together. The top panel 46, preferably at the same time, is folded around fold line 54 so that it is superposed over a portion of the top panel 44 and the open portion formed by the cut line 60 and the end sections 154 and 162 are sandwiched in between. These portions are not adhesively secured together. The structure prior to folding over the top panel 46 is illustrated in FIG. 5. The top panel 48 is then folded around fold line 56 until it is superposed over the top panels 44 and 50 and the central portion of the top panel 44. At least the facing portions of the top panels 48, 46, 50 and 44 are secured together. The fold lines 78 and 80 are superposed over the fold lines 70 and 72 and the tab portions 76 and 84 extend in opposite directions.

Figure 6:
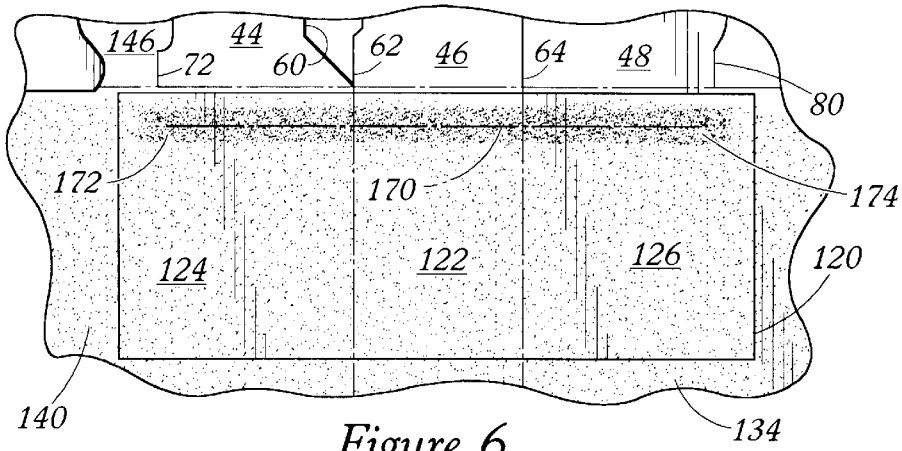
FIG. 6 is a enlarged portion of FIG. 5 illustrating one of the weakened portions.

In FIG. 6, there is illustrated part of the structures for forming the flip top lid for the carton of this invention as described below. The generally rectangular sheet 140 is superposed over the inner surface of the outer layer of the carton blank 2 of FIG. 2 and is secured thereto by a suitable adhesive illustrated by the dotted portion. The generally rectangular sheet 140 also is superposed over the generally rectangular first inner layer or insert 120. A weakened portion 170 having end portions 172 and 174 is formed in the generally rectangular sheet 140. In a preferred embodiment of the invention, the length of the weakened portion 170 between the end portions 172 and 174 is less than the distance between the fold lines 72 and 80 as illustrated in FIG. 6. The weakened portion 170 is surrounded by an adhesive, illustrated by the more heavily dotted area, to preserve the fluid tightness between the portion of the generally rectangular sheet 140 and the first inner layer or insert 120. The weakened portion 170 may comprise a cut line or a perforated line and may be formed using a heated cutting apparatus (not shown) so that, as the weakened portion 170 is made, the portions of the generally rectangular sheet 140 surrounding the weakened portion 170 are secured to the first inner layer or insert 120. In another embodiment of the invention, a coating of a suitable adhesive, such as a conventional hot or cold melt adhesive, may be used as long as the fluid impervious characteristic of the second inner layer or generally rectangular sheet 140 is maintained. The weakened portion 164 is preferably located as close as possible to the upper edge 132 of the first inner layer or insert 120 for purposes described below. The location of the weakened portion 164 as shown in FIG. 6 is for illustration purposes only.

Figure 7:
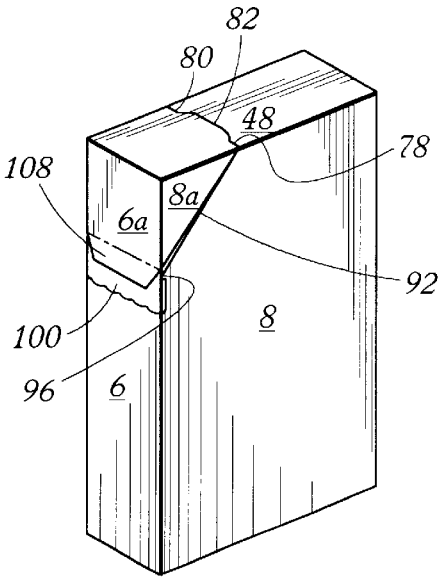
FIG. 7 is a perspective view of a closed carton of this invention.
Figure 8:
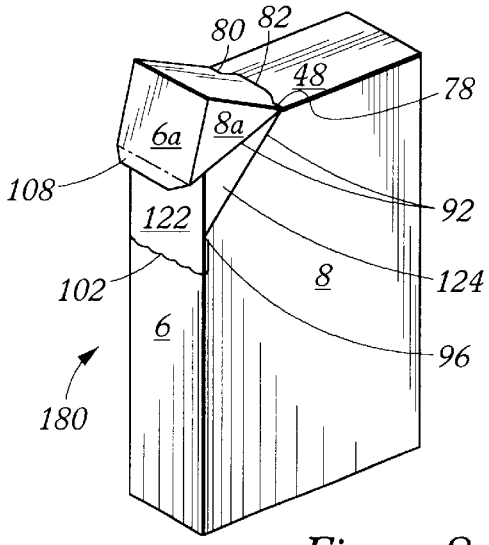
FIG. 8 is a perspective view of a partially opened carton of this invention.
Figure 9:
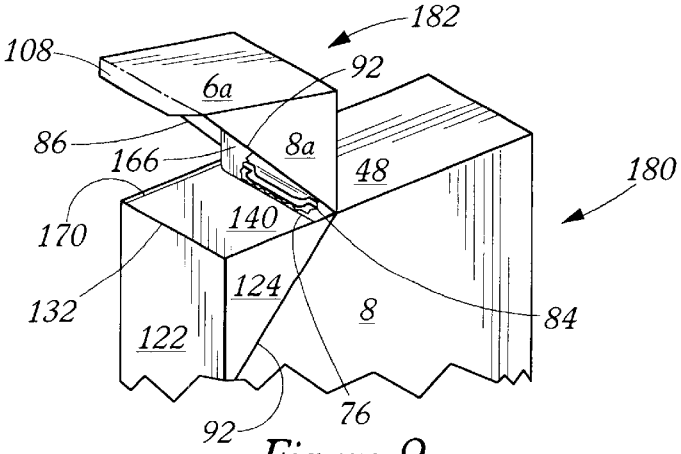
FIG. 9 is an enlarged perspective view of a opened carton of this invention wherein the flip top lid is being retained in an opened position.

A carton 180 formed from the carton blank 2 of FIGS. 1 and 2 and having its top portion formed as illustrated in FIGS. 3–5 is illustrated in FIGS. 7–9. In FIG. 7, the carton 180 is one that has been filled with the desired material as described above. In FIG. 8, the flip top lid 182 having portions 4*a*, 6*a* and 8*a* secured from the sidewall panels 4, 6 and 8 and the tab portion 108 has been partially opened. As illustrated in FIG. 8, the opening tab 100 has been removed by applying a force thereto at the fold line 14 and severing it along the perforated lines 104, 102, 98 and 106. Another force has been applied to the tab 108 to sever the outer layer along the perforated lines 86 and 92. At the same time, the force separates the weakened portion 170 since the portion 162 located between the folded over top panel 46 and the top panel 44 applies the force to the weakened portion 170. The tab portion 84 has separated along the score line 82 as the flip top lid 182 moves upwardly in a pivoted manner through an arcuate path defined by the fold lines 78 and 80. The pivotal movement of the flip top lid 182 is continued until the outer surface (not numbered) of the tab portion 84 faces the outer surface (not numbered) of the tab portion 76. This pivotal movement is generally about 120 degrees. In FIG. 9, the flip top lid 182 is held in an opened position by the cooperation between outer surfaces of the tab portions 76 and 84 which generally is about 90 degrees so that an amount of the desired material may be removed from the carton 180. After an amount of the desired material has been removed from the carton 180, a force is applied to the flip top lid 182 to return it generally to the position illustrated in FIG. 7 but with the opening tab 100 removed.

Figure 10:
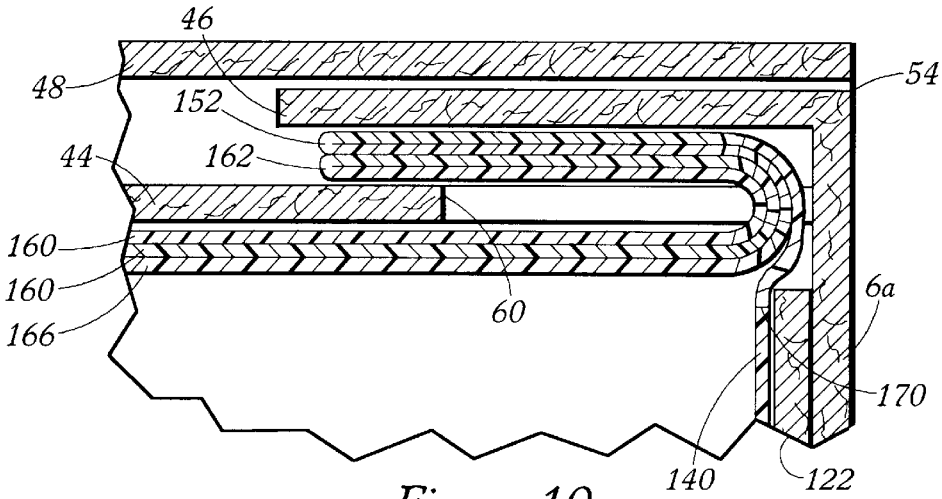
FIG. 10 is a schematic elevational view with parts in section of a portion of the top of a carton prior to the formation of the opening therein.
Figure 12:
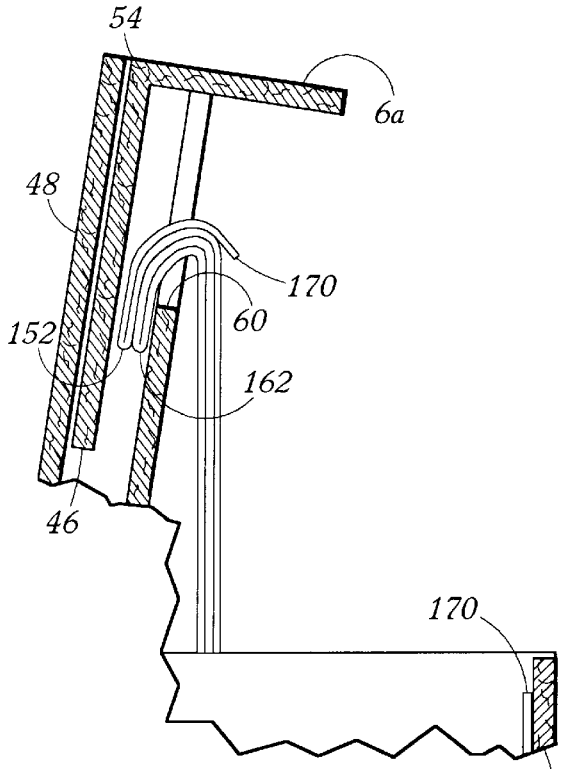
FIG. 12 is a schematic elevational view with parts in section and wherein the flip top lid is being held in the opened position.
Figure 11:
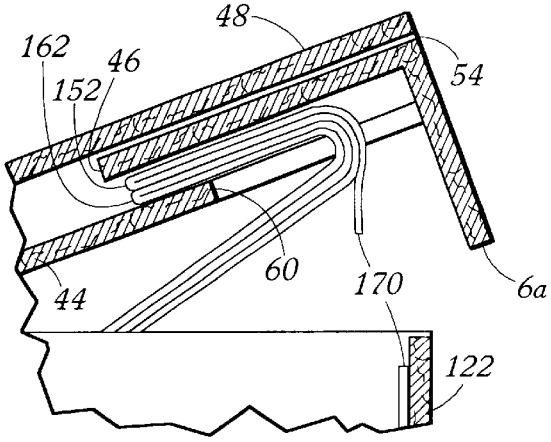
FIG. 11 is a schematic elevational view with parts in section and wherein the flip top lid has been formed and is partially opened.

FIGS. 10–12 illustrate the location of the various components of the invention at different times during the formation of the opening in the carton 180. In FIG. 10, the carton 180 has not been opened. In FIG. 1, the carton 180 has been partially opened. In FIG. 12, the carton 180 has been fully opened and the flip top lid 182 is being held in an opened position so that an amount of the desired material may be removed from the carton 180. In FIG. 12, the flip top lid 182 has been moved to a partially opened position. Part of the weakened portion 110 has been severed. The portion of the weakened portion 170 between the panels 6 and 6*a* and part of the weakened portion 170 between the panels 4 and 4*a* and 8 and 8*a* has been separated. Since the end sections of the fin joint are sandwiched between portions of the top panels 44 and 46, a force is applied to the end sections 152 and 162 and portions of the portions 166 and 168 of the fin joint to pull these portions downwardly through the opening 68 formed by the cut line 60. In FIG. 12, the weakened portion 170 has been completely severed and a large portion of the end sections 152 and 162 and the portions 166 and 168 of the fin joint have been moved through the opening 68. As described above, the contact between the outer surfaces of the tab portions 76 and 84 holds the flip top lid 182 in the opened position so that an amount of the desired material may be removed from the carton 180. In FIGS. 10–12, the strips 146 and 150 of a relatively flexible material are not shown but would be included in a preferred embodiment of the invention.

It is contemplated that the inventive concepts herein described may be variously otherwise embodied and it is intended that the appended claims be construed to include alternative embodiments of tie invention except insofar as limited by the prior art.

What is claimed is:

1. A carton blank comprising:

an outer layer comprising a first generally rectangular sheet of a relatively rigid material and having an outer surface and an inner surface;

said outer layer having a plurality of cut and fold lines formed therein for dividing said outer layer into a plurality of panels;

said outer layer having at least a first sidewall panel being integral with a second sidewall panel and a third sidewall panel and joined thereto by opposite fold lines;

a first top panel integral with said first sidewall panel and joined thereto by a fold line;

a second top panel integral with said second sidewall panel and joined thereto by a fold line;

a third top panel integral with said third sidewall panel and joined thereto by a fold line;

a first inner layer comprising a second generally rectangular sheet of a relatively rigid material having an outer surface and an inner surface;

said second generally rectangular sheet being opposite to portions of said first, second and third sidewall panels;

said second generally rectangular sheet having at least a first partial sidewall panel integral with a second partial sidewall panel and a third partial sidewall panel and secured thereto by opposite fold lines;

said first sidewall panel and said first partial sidewall panel having substantially the same width between said opposite fold lines thereof;

said second generally rectangular sheet having an upper edge portion and a lower edge portion;

at least a portion of said first partial sidewall panel adjacent to said lower edge being secured to at least a portion of said first sidewall panel;

said upper edge portion being located adjacent to but spaced from said fold lines between said first, second and third sidewall panels and said first, second and third top panels;

a second inner layer comprising a generally rectangular sheet of a relatively flexible fluid impervious material and having an outer surface and an inner surface;

at least portions of said outer surface of said second inner layer being secured to opposite portions of said inner surface of said outer layer;

at least other portions of said outer surface of said second inner layer being secured to at least portions of said inner surface of said first inner layer;

said second inner layer having a weakened portion located adjacent to but spaced from said upper edge of said first inner layer;

portions of said outer surface of said second inner layer surrounding said weakened portion being secured to opposite portions of said inner surface of said first inner layer; and a continuous weakened portion in portions of said first, second and third sidewall panels for cooperating with said weakened portion in forming an opening in a carton formed from said outer layer and said first and second inner layers so that said weakened portions may be broken to form an opening in said carton and a flip top lid for opening or closing said opening.

2. A carton blank as in claim 1 wherein said continuous weakened portion comprises:

a first portion located in said first sidewall panel adjacent to but spaced from said at least a portion of said first sidewall panel and having end portions located in said opposite fold lines;

a second portion located in said second sidewall panel and extending at an acute angle between one of said end portions and said fold line between said second sidewall panel and said second top panel; and a third portion located in said third sidewall panel and extending at an acute angle between the other of said end portions and said fold line between said third sidewall panel and said third top panel.

3. A carton blank as in claim 1 wherein:

said cut lines between said first and third top panels being spaced apart so that an open space is formed between said first and third top panels.

4. A carton blank as in claim 1 wherein:

said second top panel having opposite spaced apart fold lines extending in a direction substantially perpendicular to said fold line between said second top panel and said second sidewall panel;

an arcuate shaped score line in said second top panel extending between said opposite spaced apart fold lines;

said third top panel having opposite spaced apart fold lines extending in a direction substantially perpendicular to said fold line between said third top panel and said third sidewall panel; and an arcuate shaped score line in said third top panel extending between said opposite spaced apart fold lines.

5. A carton blank as in claim 4 wherein:

said opposite spaced apart fold lines in said second and third top panels being located so that they are in a superposed position when said third top panel is superposed over said second top panel; and said arcuate shaped score lines in said second and third top panels extend in opposite directions when said third top panel is superposed over said second top panel.

6. A carton blank as in claim 1 and further comprising:

said carton blank having a fourth sidewall panel integral with one of said second and third sidewall panels and joined thereto by a fold line;

a glue tab panel integral with said fourth sidewall panel and joined thereto by a fold line;

a fourth top panel integral with said fourth sidewall panel and joined thereto by a fold line;

a first, second, third and fourth bottom panels respectively integral with said first, second, third and fourth sidewall panels and joined thereto by fold lines;

a fist strip of a relatively flexible material superposed over at least said first, second, third and fourth top panels and portions of said first, second, third and fourth sidewall panels adjacent to said fold lines between said top panels and said sidewall panels and secured to portions of said outer surface of said second inner layer; and a second strip of a relatively flexible material superposed over at least said first, second, third and fourth bottom panels and portions of said first, second, third and fourth sidewall panels adjacent to said fold lines between said bottom panels and said sidewall panels and secured to other portions of said outer surface of said second inner layer.

7. A carton blank as in claim 6 wherein said continuous weakened portion comprises:

a first portion located in said first sidewall panel adjacent to but spaced from a portion of said lower edge and having end portions located in said opposite fold lines;

a second portion located in said second sidewall panel and extending at an acute angle between one of said end portions and said fold line between said second sidewall panel and said second top panel; and a third portion located in said third sidewall panel and extending at an acute angle between the other of said end portions and said fold line between said third sidewall panel and said third top panel.

8. A carton blank as in claim 7 wherein:

said cut lines between said first and third top panels being spaced apart so that an open space is formed between said first and third top panels.

9. A carton blank as in claim 8 wherein:

said second top panel having opposite spaced apart fold lines extending in a direction substantially perpendicular to said fold line between said second top panel and said second sidewall panel;

an arcuate shaped score line in said second top panel extending between said opposite spaced apart fold lines;

said third top panel having opposite spaced apart fold lines extending in a direction substantially perpendicular to said fold line between said third top panel and said third sidewall panel;

an arcuate shaped score line in said third top panel extending between said opposite spaced apart fold lines;

said opposite spaced apart fold lines in said second and third top panels being located so that they are in a superposed position when said third top panel is superposed over said second top panel; and said arcuate shaped score lines in said second and third top panels extend in opposite directions when said third top panel is superposed over said second top panel.

10. A carton blank as in claim 1 wherein:

said weakened portion having opposite end portions; and the distance between said opposite end portions is less than the distance between one of said opposite spaced apart fold lines in said second top panel and the corresponding one of said opposite spaced apart fold lines in said third top panel.

11. A dispensing carton comprising:

a plurality of sidewall panels folded around parallel fold lines and held in folded relationship by a glue tab panel to form a central body portion;

said plurality of sidewall panels comprising at least one sidewall panel having integral second and third sidewall panels joined thereto by opposite fold lines;

an inner insert having at least a first partial sidewall panel, a second partial sidewall panel and a third partial sidewall panel superposed over portions of said first, second and third sidewall panels;

said insert having top and bottom edges;

said first partial sidewall panel being secured to facing portions of said first sidewall panel at a location adjacent to said bottom edge;

a continuous fluid impervious liner for said carton having a central body portion, a top portion and a bottom portion;

a plurality of bottom panels integral with said plurality of sidewall panels and joined thereto by fold lines;

a plurality of top panels integral with said plurality of sidewall panels and joined thereto by fold lines;

said bottom portion and said bottom panels being folded and secured together in a fluid tight relationship;

said top portion and said top panels being folded and secured together in a fluid tight relationship;

a first continuous weakened portion in portions of said first, second and third sidewall panels;

a second continuous weakened portion in said continuous fluid impervious liner in a portion thereof spaced from said top edge;

the portion of said fluid impervious liner surrounding said second weakened portion being secured to said insert; and said first and second weakened portions when broken providing an opening and a flip top lid for said carton.

12. A dispensing carton as in claim 11 and further comprising:

one of said plurality of top panels comprising a second top panel integral with said second sidewall panel;

said second top panel having opposite spaced apart fold lines extending in a direction substantially perpendicular to said fold line between said second top panel and said second sidewall panel;

an arcuate shaped score line in said second top panel extending between said opposite spaced apart fold lines;

another one of said plurality of top panels comprising a third top panel integral with said third sidewall panel;

said third top panel having opposite spaced apart fold lines extending in a direction substantially perpendicular to said fold line between said third top panel and said third sidewall panel; and an arcuate shaped score line in said third top panel extending between said opposite spaced apart fold lines.

13. A dispensing carton as in claim 12 wherein:

said opposite spaced apart fold lines in said second and third top panels being in a superposed position; and said arcuate shaped score lines in said second and third top panels extending in opposite directions.

14. A dispensing carton as in claim 11 wherein:

said top portion of said continuous fluid impervious liner being formed into a closed and folded configuration to form a fin joint having a central body portion and two opposite outwardly extending portions and wherein said central body portion has been folded over one of said two outwardly extending portions;

said top panels comprising two relatively long top panels and two relatively short top panels;

said fin joint having a central section and two opposite end sections;

one of said relatively long top panels superposed over said central section;

each of said two opposite end sections being folded and superposed over at least portions of opposite end portions of said one of said relatively long top panels;

each of said relatively short top panels being folded over and superposed over one of said folded over two opposite end sections; and the other of said two relatively long top panels being folded over, superposed over and secured to said folded over two relatively short top panels and the portion of said one of said two relatively long top panels located between said folded over two relatively short top panels.

15. A dispensing carton as in claim 14 and further comprising:

one of said plurality of top panels comprising a second top panel integral with said second sidewall panel;

said second top panel having opposite spaced apart fold lines extending in a direction substantially perpendicular said fold line between said second top panel and second sidewall panel;

an arcuate shaped score line in said second top panel extending between said opposite spaced apart fold lines;

another one of said plurality of top panels comprising a third top panel integral with said third sidewall panel;

said third top panel having opposite spaced apart fold lines extending in a direction substantially perpendicular to said fold line between said third top panel and said third sidewall panel; and an arcuate shaped score line in said third top panel extending between said opposite spaced apart fold lines.

16. A dispensing carton as in claim 15 wherein:

said opposite spaced apart fold lines in said second and third top panels being in a superposed position; and said arcuate shaped score lines in said second and third top panels extending in opposite directions.

17. A dispensing carton as in claim 16 wherein:

said two relatively short top panels being folded and superposed over at least portions of said one of said relatively long top panels so that at least portions of said folded over opposite end sections are sandwiched therebetween; and said one of said relatively long top panels being dimensioned so that at least a portion of one of said folded over end sections is not sandwiched between one of said folded over said two relatively short top panels and said one of said two relatively long top panels.

18. A dispensing carton as in claim 17 and further comprising:

a flip top lid formed by separating said first and second continuous weakened portion;

said flip top lid being pivotally mounted on said two relatively long top panels by said superposed fold lines for movement between an opened and a closed position; and apparatus associated with each of said two relatively long top panels for holding said flip top lid in said opened position.

19. A carton as in claim 18 wherein said apparatus comprises:

a tab portion in each of said two relatively long top panels formed by breaking said arcuately shaped score lines; and at least portions of said tab portions being in a contacting relationship.

20. A method for forming a secured together top portion for a container comprising at least an outer layer comprising a plurality of sidewall panels and a glue panel folded around fold lines and secured together; a plurality of bottom panels integral with said plurality of sidewall panels and joined thereto by fold lines; a plurality of top panels integral with said plurality of sidewall panels and joined thereto by fold lines and wherein the plurality of top panel comprise two relatively long top panels and two relatively short top panels; at least an inner layer comprising a flexible fluid impervious material having a central body portion, a bottom portion and a top portion wherein the central body portion is secured to at least portions of said plurality of sidewall panels and wherein the plurality of bottom panels and the bottom portion are folded and secured together to form an open ended carton ready to be filled with a desired material and wherein the fold lines between the plurality of top panels and the plurality of sidewall panels lie in a common plane and wherein the open ended carton has been filled with a desired material comprising:

folding and continuously sealing together portions of said top portion so as to have a central body portion and two opposite outwardly extending portions lying substantially in said common plane with said central body portion extending in a direction substantially parallel with said two relatively long top panels;

folding one of said two relatively long top panels to a location wherein it is superposed over said central section;

folding each of said two relatively short top panels so that one of said two opposite end sections is located between each of said two relatively short top panels and spaced apart portions of said one of said two relatively long top panels;

folding the other of said two relatively long top panels until it is superposed over said folded two relatively short top panels and the portion of said one of said two relatively long top panels located therebetween;

securing together facing portions of said other of said two relatively long top panels and said two relatively short top panels and said portion of said one of said two relatively long top panels;

wherein the plurality of sidewall panels comprise at least a first sidewall panel integral with a second and a third sidewall panel and connected thereto by fold lines; a first continuous weakened portion formed in the first, second and third sidewall panels to form separable portions of the first, second and third sidewall panels; an inner insert having at least first, second and third partial sidewalls joined by fold lines and superposed over portions of the first, second and third sidewall panels; the inner insert having upper edge and a lower edge; the first partial sidewall panel being secured to said first sidewall panel at a location adjacent to the bottom edge of the first partial sidewall panel; the inner insert being enclosed within and secured to a portion of the inner layer of a flexible impervious sheet; a second continuous weakened portion formed in a portion thereof parallel to and spaced from a portion of the top edge and additional weakened portions to form a pull tab;

applying a first force on said additional weakened portions to remove said pull tab;

breaking said first weakened portion so that said separable portions of said first, second and third sidewall panels can be moved;

moving said separable portions of said first, second and third sidewall panels in an arcuate path;

gradually severing said second weakened portion by said movement of said separable portions of said first, second and third sidewall panels to form an opening in said carton.

21. A method as in claim 20 and further comprising:

holding said separable portions of said first, second and third sidewall panels in an opened position so that an amount of the desirable material may be removed from said carton.

* * * * *

UNITED STATES PATENT AND TRADEMARK OFFICE

CERTIFICATE OF CORRECTION

PATENT NO. : 6,386,438 B1
DATED : May 14, 2002
INVENTOR(S) : Walsh et al.

It is certified that error appears in the above-identified patent and that said Letters Patent is hereby corrected as shown below:

Column 3,
Line 21, delete "wit" and insert therefor -- with --

Column 4,
Line 7, delete "short panel" and insert therefor -- short panels --
Line 39, after "between" delete "of"
Line 59, delete "a" and insert therefor -- an --

Column 5,
Line 15, delete "materials comprising" and insert therefor -- material comprising --

Column 8,
Line 17, delete "FIG. 1" and insert therefor -- FIG. 11 --
Line 22, delete "110" and insert therefor -- 170 --
Line 43, delete "tie" and insert therefor -- the --

Column 10,
Line 28, delete "fist" and insert therefor -- first --

Column 13,
Line 43, delete "top panel" and insert therefor -- top panels --

Column 14,
Line 30, after "having" insert -- an --

Signed and Sealed this

Eighth Day of October, 2002

*Attest:*

*Attesting Officer*

JAMES E. ROGAN
*Director of the United States Patent and Trademark Office*